US008807049B2

(12) United States Patent
Gotou

(10) Patent No.: US 8,807,049 B2
(45) Date of Patent: Aug. 19, 2014

(54) VIBRATION SUPPRESSION DEVICE FOR RAILWAY VEHICLE

(75) Inventor: Osamu Gotou, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/818,117

(22) PCT Filed: Aug. 22, 2011

(86) PCT No.: PCT/JP2011/004645

§ 371 (c)(1),
(2), (4) Date: Feb. 21, 2013

(87) PCT Pub. No.: WO2012/026102

PCT Pub. Date: Mar. 1, 2012

(65) Prior Publication Data

US 2013/0145955 A1 Jun. 13, 2013

(30) Foreign Application Priority Data

Aug. 25, 2010 (JP) ..... 2010-188247

(51) Int. Cl.
*B61F 3/00* (2006.01)

(52) U.S. Cl.
USPC ..... 105/199.1; 105/199.2

(58) Field of Classification Search
CPC ..... B61F 1/00; B61F 1/50; B61F 1/512; B61F 1/5127; B61F 1/114; B61F 1/5308; B61F 1/524; B61F 1/5245; B61F 1/514
USPC ..... 104/199.1, 199.2, 453
See application file for complete search history.

(56) References Cited

FOREIGN PATENT DOCUMENTS

| | | |
|---|---|---|
| JP | 4-372459 | 12/1992 |
| JP | 5-184002 | 7/1993 |
| JP | 7-81561 | 3/1995 |
| JP | 11-222128 | 8/1999 |
| JP | 11-278262 | 10/1999 |
| JP | 2003-267216 | 9/2003 |
| JP | 3541967 | 7/2004 |
| JP | 2008-247335 | 10/2008 |
| JP | 2009-33793 | 2/2009 |
| JP | 2009-35068 | 2/2009 |
| JP | 2009-101961 | 5/2009 |
| TW | 1238926 | 9/2005 |

*Primary Examiner* — Jason C Smith
(74) *Attorney, Agent, or Firm* — Clark & Brody

(57) ABSTRACT

A vibration suppression device for a railway vehicle includes an actuator (5) disposed between a bogie truck (2) and a vehicle body (1), the actuator adjusting a vibration of the railway vehicle by extension/retraction motion thereof, and a controller (4) for controlling the extension/retraction motion of the actuator (5), and the controller (4) derives the total amount of extension/retraction displacements of the actuator (5) within a predetermined period of time during the running of the railway vehicle, and compares the derived total amount of extension/retraction displacements with a preliminarily registered threshold value to determine that the actuator (5) is seized in the case where the total amount of extension/retraction displacements is smaller than the threshold value. Thereby, seizing of the actuator can be self-diagnosed and found at an early stage.

19 Claims, 2 Drawing Sheets

VIBRATION SUPPRESSION DEVICE FOR RAILWAY VEHICLE

TECHNICAL FIELD

The present invention relates to a vibration suppression device for a railway vehicle provided with an actuator for causing a damping effect on a vibration generated in the railway vehicle by extension/retraction motion thereof, particularly to a vibration suppression device for a railway vehicle capable of self-diagnosing the state of the operation of an actuator.

BACKGROUND ART

In a railway vehicle such as a Shinkansen bullet train, during running, vibration acceleration in motion such as vertical motion, lateral motion, rolling and yawing is imposed and a vibration is generated. Therefore, in a railway vehicle, a vibration suppression device for suppressing various vibrations is mounted. As a damping force generation mechanism of the vibration suppression device, an air cushion, a fluid pressure damper utilizing pneumatic pressure or hydraulic pressure, an actuator of fluid pressure type such as pneumatic pressure or hydraulic pressure as a drive source, an electric actuator with electric power as a drive source, and the like are used. These are disposed between a bogie truck and a vehicle body of the railway vehicle.

In the actuator among these damping force generation mechanisms, a main body is coupled to either the bogie truck side or the vehicle body side, and a movable rod is coupled to the other side. With the rod being extended or retracted in association with a generated vibration, the actuator exerts to vibrate the vehicle body and at the same time, to adjust a damping force of the actuator itself to attenuate the vibration. At this time, in the fluid pressure type actuator, a rod (piston rod) is arranged inside a cylinder on the main body side, and by controlling a supply amount (sealed amount) of compressed air or oil into the cylinder, the rod is extended and retracted. In the electric actuator, a rod is arranged in a coaxial manner with a main shaft of an electric motor on the main body side via a ball screw mechanism, and by controlling a rotation angle of the electric motor, rotation motion of the electric motor is converted into linear motion and the rod is extended and retracted.

In the vibration suppression device using the actuator, a failure that extension/retraction motion of the actuator is disabled (hereinafter, this failure will be referred to as "seizing") can be generated. The seizing of the fluid pressure type actuator is generated in the case where a port for supplying the compressed air or the oil to the cylinder remains opened or closed due to some troubles, or the like. The seizing of the electric actuator is generated in the case where the ball screw mechanism gets stuck by a foreign substance, or the like.

In the case where the seizing is generated in the fluid pressure type actuator, the actuator is brought into the state of having lower rigidity to allow extension/retraction of the rod a little owing to a compression characteristic of the fluid retained in the cylinder. Meanwhile, in the case where the seizing is generated in the electric actuator, the actuator is brought into the state of having higher rigidity substantially which does not allow the extension/retraction of the rod. In any of the actuators, generation of the seizing does not immediately cause fatal damage to running safety and riding comfort but undeniably deteriorates the riding comfort. Particularly, in the electric actuator to be brought into the state of higher rigidity in accordance with the generation of the seizing, the level of degradation of the riding comfort is intensified.

Therefore, in the case where the actuator is seized, there is a need for repairing or replacing the actuator. As a technique in the background art for this demand, for example, PATENT LITERATURE 1 and 2 disclose a technique in which when a railway vehicle is out of service, an actuator is intentionally activated to vibrate a vehicle body, the vibration acceleration of the vibrated vehicle body is detected by an acceleration sensor, the detected vibration acceleration is compared to a reference value, and in the case where the vibration acceleration is smaller than the reference value, it is diagnosed that the actuator is in a fault condition.

CITATION LIST

Patent Literature

PATENT LITERATURE 1 Japanese Patent Application Publication No. 05-184002

PATENT LITERATURE 2 Japanese Patent Application Publication No. 2003-267216

SUMMARY OF THE INVENTION

Technical Problem

Although according to the technique described in PATENT LITERATURE 1 and 2, the seizing of the actuator can be diagnosed and the actuator can be repaired or replaced from a diagnosis result thereof, seizing diagnosis can be performed only when a railway vehicle is out of service. That is, in reality, the seizing of the actuator can be found only at the time of periodic checkup performed about once a month in a maintenance factory of the railway vehicle. Therefore, there is sometimes an occasion where the seizing of the actuator is not found for a long time and the railway vehicle is operated in a state where the riding comfort is degraded along with the seizing of the actuator.

An object of the present invention, which has been achieved in view of the circumstances above, is to provide a vibration suppression device for a railway vehicle capable of self-diagnosing and finding the seizing of an actuator, the device causing a damping effect on a vibration generated in a railway vehicle by extension/retraction motion thereof at an early stage.

Solution to Problem

As a result of much dedicated examination in order to achieve the above object, the present inventor found that in order to find the seizing of an actuator at an early stage, seizing diagnosis which is performed during the running in operation of a railway vehicle is effective, and further that in order to perform the seizing diagnosis with high precision even during running, it is effective to evaluate an extension/retraction displacement value of the actuator with a total amount within a predetermined period, instead of an instantaneous value.

The present invention is achieved based on such findings, and the summary thereof lies in a vibration suppression device for a railway vehicle described below.

The present invention is directed to a vibration suppression device for a railway vehicle, including an actuator disposed between a bogie truck and a vehicle body of the railway vehicle, the actuator adjusting a vibration of the railway vehicle by extension/retraction motion thereof, and a controller for controlling the extension/retraction motion of the actuator, wherein the controller derives the total amount of extension/retraction displacements of the actuator within a predetermined period of time during the running of the railway vehicle, and uses the derived total amount of extension/retraction displacements to determine whether or not the actuator is seized. Here, for example, the derived total amount of extension/retraction displacements and a preliminarily registered first threshold value are compared to each other. In the case where the total amount of extension/retraction displacements is smaller than the first threshold value, it is determined that the actuator is seized.

In the above vibration suppression device, it is preferable for the actuator to be an electric actuator for converting rotation motion of an electric motor into extension/retraction motion.

In the above vibration suppression device, it is preferable for a sensor for detecting extension/retraction displacement of the actuator, a sensor for detecting extension/retraction speed of the actuator, or sensors for detecting accelerations in the extension/retraction direction, the sensors being respectively provided at the end of the actuator on the bogie truck side and at the end on the vehicle body side to be provided; and for the controller to derive the total amount of extension/retraction displacements based on detection signals of the sensor or sensors.

In a case of the vibration suppression device including these sensors, it is preferable for the controller to process the detection signal of the sensor through a band-pass filter and derive the total amount of extension/retraction displacements based on the processed signal; or to process the detection signal of the sensor through a low-pass filter, perform the processing of subtracting a preliminarily registered zero-point value of the sensor, and derive the total amount of extension/retraction displacements based on the processed signals.

In the above vibration suppression device, it is desirable for the controller to derive the total amount of extension/retraction displacements when a running speed of the railway vehicle exceeds a preliminarily registered speed.

In the above vibration suppression device, the controller may derive the total amount of extension/retraction displacements of the actuator, derive the Root Mean Square value (RMS value) of the vibration acceleration acting on the vehicle body in the same direction as the extension/retraction direction of the actuator within the predetermined period of time, and use the derived total extension/retraction displacement amount and the derived RMS value of vibration acceleration data to determine whether or not the actuator is seized. Here, for example, the derived total amount of extension/retraction displacements and the preliminarily registered first threshold value are compared to each other and the derived RMS value of the vibration acceleration data and a preliminarily registered second threshold value are compared to each other. In the case where the total amount of extension/retraction displacements is smaller than the first threshold value and the RMS value of vibration acceleration data is larger than the second threshold value, it is determined that the actuator is seized.

In the vibration suppression device, a vibration acceleration sensor is preferably provided for detecting vibration acceleration acting on the vehicle body in the same direction as extension/retraction direction of the actuator; and it is preferable for the controller to process a detection signal of the vibration acceleration sensor through a band-pass filter, and derive the RMS value of vibration accelerations based on the processed signal.

Advantageous Effects of Invention

According to the vibration suppression device for a railway vehicle of the present invention, the seizing diagnosis of an actuator can be performed during the running of a railway vehicle. Thus, the seizing of the actuator can be found at an early stage and promptly remedied. Since the total amount of extension/retraction displacements of the actuator within a predetermined period of time is adopted as an evaluation measure of the seizing diagnosis, the seizing diagnosis can be performed with high precision.

DESCRIPTION OF EMBODIMENTS

Hereinafter, an embodiment of a vibration suppression device for a railway vehicle of the present invention will be described in detail.

Figure 1:
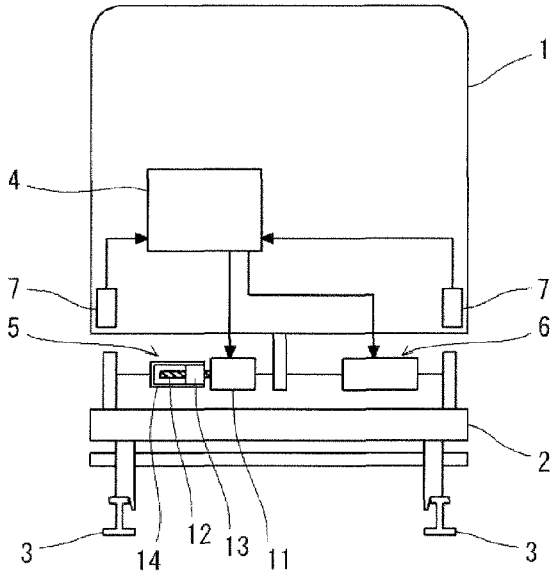
FIG. 1 is a schematic view showing a configuration example of a railway vehicle in which a vibration suppression device of the present invention is mounted.

FIG. 1 is a schematic view showing a configuration example of a railway vehicle in which the vibration suppression device of the present invention is mounted. As shown in the figure, a vehicle in the railway includes a vehicle body 1, and bogie trucks 2 supporting the vehicle body 1 at front and rear sides along a longitudinal direction, and runs on rails 3. Between the bogie truck 2 and the vehicle body 1, an actuator 5 capable of extending and retracting in a lateral direction of the vehicle is disposed in place.

The actuator 5 shown in FIG. 1 is an electric actuator in which threaded grooves are formed in a main shaft 12 of an electric motor 11 as being the main body, a ball screw nut 13 is screwed onto the main shaft 12, and a rod 14 in a coaxial manner to the main shaft 12 is fixed to the ball screw nut 13. In the actuator 5, one end on the side of the electric motor 11 is coupled to the vehicle body 1 of the railway vehicle, and the other end on the side of the rod 14 is coupled to the bogie truck 2 of the railway vehicle.

Between the bogie truck 2 and the vehicle body 1, a fluid pressure damper 6 capable of changing a damping force is disposed in parallel with the actuator 5. At four corners in front behind left and right in the vehicle body 1, vibration acceleration sensors 7 for detecting vibration acceleration in a lateral direction are installed. In the vehicle body 1, a controller 4 for controlling operations of the actuator 5 and the fluid pressure damper 6 is installed.

During the running of the vehicle, in the actuator 5, in accordance with the vibration acceleration of the vehicle body 1 detected by the vibration acceleration sensors 7 due to a generated vibration, through the command of the controller 4, a rotation angle of the main shaft 12 of the electric motor 11 is controlled. Thereby, rotation motion of the main shaft 12 of the electric motor 11 is converted into linear motion by a ball screw mechanism and the rod 14 is extended and retracted, so that the actuator 5 exerts to vibrate the vehicle body 1 and at the same time, adjusts the damping force of the actuator itself so as to attenuate the vibration. At this time, in the railway vehicle shown in FIG. 1, the fluid pressure damper 6 also causes a vibration damping effect.

In the above example, in order to suppress the vibration in a lateral direction of the vehicle, as a vibration suppression device, the actuator 5 is installed so as to be extendable and retractable in a lateral direction, and the vibration acceleration sensors 7 for detecting the vibration acceleration in a lateral direction are installed. However, the directions of installation of the actuator 5 and the vibration acceleration sensors 7 can be changed so as to coincide with the direction of a vibration of an object to be suppressed, for example, the longitudinal direction or the vertical direction of the vehicle. A fluid pressure type actuator can also be used as the actuator 5.

In the railway vehicle in which the vibration suppression device is mounted in such a way, the controller 4 can control vibration suppression with the above actuator 5 during running, and at the same time, perform seizing diagnosis of the actuator 5. Hereinafter, specific procedures of the seizing diagnosis will be described.

Figure 2:
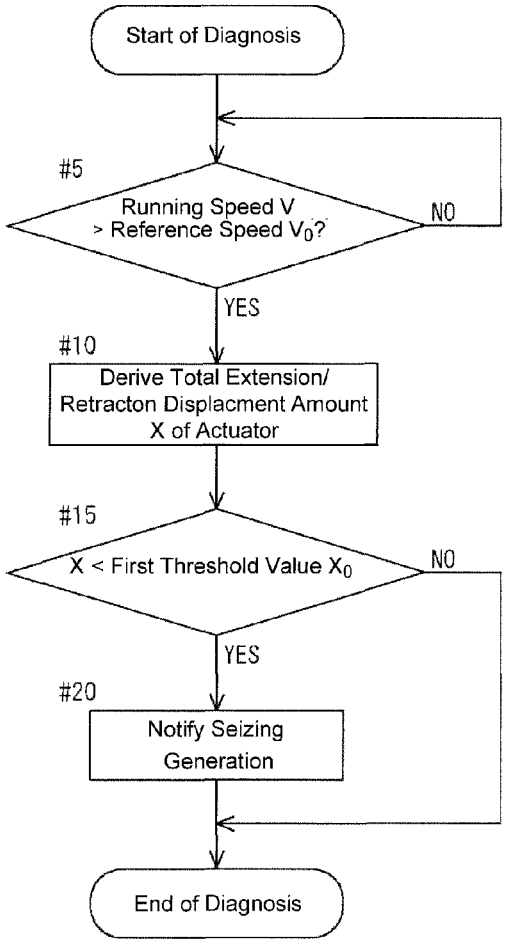
FIG. 2 is a flowchart showing procedures of seizing diagnosis of an actuator according to the vibration suppression device of the present invention.

FIG. 2 is a flowchart showing the procedures of the seizing diagnosis of the actuator according to the vibration suppression device of the present invention. During the running of the railway vehicle, a diagnosis mode is employed under a preliminarily set condition or by direct input of a driver. At this time, even when shifting to the diagnosis mode, control of the vibration suppression by the actuator is continued.

After shifting to the diagnosis mode, in Step #5, the controller determines whether or not a running speed V of the vehicle exceeds a specified reference speed $V_0$. Information of the reference speed $V_0$ is preliminarily registered in the controller, and the running speed V can be acquired by such a way that the controller receives by transmission from a vehicle information controller mounted for example in a first vehicle of the railway or the controller itself receives speed pulses and performs calculation. In Step #5, the reference speed $V_0$ may be registered in the vehicle information controller. In this case, the vehicle information controller may compare the running speed V and the reference speed $V_0$ and determine whether or not the running speed V exceeds the reference speed $V_0$, and the controller may receive a determination result thereof by transmission.

When it is determined that the running speed V exceeds the reference speed $V_0$ in Step #5, the processing advances to Step #10, and the controller derives the total extension/retraction displacement amount X of the actuator within a predetermined period of time T. The total extension/retraction displacement amount X can be derived by any of the following methods (1) to (3).

(1) A displacement sensor for detecting an extension/retraction displacement of the rod of the actuator is provided. The controller samples a detection signal of an extension/retraction displacement $x_i$ that is output from the displacement sensor for every predetermined cycle Δt within the predetermined period of time T, and as shown in the following Equation (a), calculates the total extension/retraction displacement amount X from the sum of differences of sampled extension/retraction displacements $x_i$.

[Equation 1]

$$X = \sum_i x_{i+1} - x_i \tag{a}$$

(2) A speed sensor for detecting an extension/retraction speed of the rod of the actuator is provided. The controller samples a detection signal of a speed $v_i$ that is output from the speed sensor for every predetermined cycle Δt within the predetermined period of time T, and as shown in the following Equation (b), multiplies the sampled speed $v_i$ by the sampling cycle Δt, and calculates the total extension/retraction displacement amount X from the sum.

[Equation 2]

$$X = \sum_i v_i \Delta t \tag{b}$$

In the case where the electric actuator is used as the actuator, a resolver for detecting the number of rotations of the electric motor can be applied as the speed sensor. The extension/retraction speed $v_i$ of the rod of the actuator can be calculated by the following Equation (c) from the number of rotations $r_i$ [rpm] that is output from the resolver at the time of sampling and the lead L [m] of a ball screw.

[Equation 3]

$$v_i = \frac{r_i}{60} L \ \text{[m/s]} \tag{c}$$

(3) Acceleration sensors for detecting accelerations in the extending and retracting direction are respectively provided at the end of the actuator on the rod side and at the end on the main body side. The controller samples detection signals of accelerations $\alpha_i$, $\beta_i$ that are output from the acceleration sensors for every predetermined cycle Δt within the predetermined period of time T, and as shown in the following Equation (d), multiplies a difference between the sampled accelerations $\alpha_i$, $\beta_i$ by the square of the sampling cycle Δt, and calculates the total extension/retraction displacement amount X from the sum.

[Equation 4]

$$X = \sum_i (\alpha_i - \beta_i)\Delta t^2 \tag{d}$$

After the total extension/retraction displacement amount X of the actuator is derived in Step #10, the processing advances to Step #15, and the controller determines whether or not the total extension/retraction displacement amount X is smaller than a specified threshold value (first threshold value) $X_0$. Information of the first threshold value $X_0$ is preliminarily registered in the controller. When it is determined that the total extension/retraction displacement amount X is smaller than the first threshold value $X_0$ in Step #15, in this case, it cannot be considered that the actuator should have extended or retracted, although the control of the vibration suppression by the actuator is performed within the predetermined period of time T. Thus, the controller determines that the actuator is seized, notifies the occurrence of seizing by generating an alarm, displaying a malfunctioning note on an operation panel of a driver seat, or the like in Step #20, and completes the diagnosis.

Meanwhile, when it is determined that the total extension/retraction displacement amount X is not smaller than the first threshold value $X_0$ in Step #15, in this case, it can be considered that the actuator should have sufficiently operated and should be normal. Thus, the controller generates no alarm, displays a well-functioning note on the operation panel of the driver seat, or the like.

In such a way, according to the vibration suppression device of the present invention, the seizing diagnosis of the actuator can be performed during running in service operation of the railway vehicle. Thus, the seizing of the actuator can be found at an early stage and promptly remedied. Therefore, a situation that the railway vehicle is operated while riding comfort is degraded for a long time is prevented. Since the total extension/retraction displacement amount of the actuator within the predetermined period of time is adopted as an evaluation measure of the seizing diagnosis, the seizing diagnosis can be performed with high precision. This is because, even in the case where the actuator is well functioning, a small vibration generated in the vehicle causes a small extension/retraction motion in the actuator, so that the evaluation by an instantaneous extension/retraction displacement amount of the actuator cannot precisely determine if the seizing should occur.

In the above embodiment, when the running speed V of the railway vehicle exceeds the reference speed $V_0$, the total extension/retraction displacement amount of the actuator is derived. This is due to the following reason. In a case of a low running speed V, even when the operation of the actuator is normal, the extension/retraction motion of the actuator is small due to a small vibration generated in the vehicle, and accordingly, the total extension/retraction displacement amount becomes small. Thus, when the total extension/retraction displacement amount with a low running speed V is evaluated, it may occur that the seizing is not accurately determined is caused. Therefore, in order to avoid a faulty determination of the seizing, it is desirable that the total extension/retraction displacement amount is derived and evaluated when the running speed V is fast, in excess of the reference speed $V_0$.

At the time of deriving the total extension/retraction displacement amount of the actuator by the above methods (1) to (3), detection signals from the displacement sensor, the speed sensor, and the acceleration sensors usually contain noises which do not relate to the extension/retraction motion of the actuator. Thus, it is preferable that the processing of removing the noises is performed. Among the detection signals of the sensors, a bandwidth of a natural frequency by the actuator between the vehicle body and the bogie truck directly relates to the extension/retraction motion of the actuator. The noises can be removed by the following processing (A) or (B).

(A) By the controller, the detection signal of the sensor is processed through a band-pass filter. The band-pass filter blocks a low-frequency bandwidth and a high-frequency bandwidth out of the bandwidth of the natural frequency by the actuator. A circuit of the band-pass filter is included in the controller.

(B) By the controller, the detection signal of the sensor is processed through a low-pass filter and a processing of subtracting a zero-point value of the sensor is performed. The low-pass filter blocks the high-frequency bandwidth out of the bandwidth of the natural frequency by the actuator. A circuit of the low-pass filter is included in the controller and information of the zero-point value of the sensor is preliminarily registered in the controller.

The above reference speed $V_0$ of the railway vehicle, the first threshold value $X_0$ serving as an evaluation reference of the total extension/retraction displacement amount X, the sampling period of time T for deriving the total extension/retraction displacement amount X, the sampling cycle Δt, and the blocked frequency bandwidth at the time of filtering the detection signal of the sensor depend on the type of the vehicle and a running environment. Thus, a running test is performed in advance to appropriately determine the above values.

For example, in a case of a Shinkansen bullet train, 160 [km/h] can be adopted as the reference speed $V_0$, and for example, 5 [mm] can be adopted as the first threshold value $X_0$ (5 [sec] as the sampling period of time T and 5 [msec] as the sampling cycle Δt). The reason why the reference speed $V_0$ is 160 [km/h] is that when the speed exceeds 160 [km/h], the vibration generated in the vehicle is usually radically increased, and the extension/retraction motion of the actuator is also increased. The reason why the first threshold value $X_0$ is 5 [mm] is that based on the fact that an actual performance of the total extension/retraction displacement amount X during running at speeds in excess of 160 [km/h] was 10 [mm] or more in the case where the actuator was well-functioning, in consideration of a safety factor, it is proper for a half of 10 [mm] serving as the actual performance to be set as the first threshold value $X_0$.

It is preferable that the sampling period of time T is within a range from 1 to 20 [sec] and the sampling cycle Δt is 10 [msec] or less. When the sampling period of time T is too short, the total extension/retraction displacement amount is decreased irrespective of the state of operation of the actuator. On the other hand, when the sampling period of time is too long, the diagnosis takes a long time. Meanwhile, when the sampling cycle is too long, the bandwidth of the natural frequency between the vehicle body and the bogie truck cannot be measured. As a specific operation, the sampling period of time T can be 5 [sec] and the sampling cycle Δt can be 5 [msec].

The bandwidth of the natural frequency by the actuator between the vehicle body and the bogie truck is about 0.5 to 3 Hz which is almost the same as that in the Shinkansen bullet train or other vehicles. The blocked frequency bandwidth at the time of filtering out of the above bandwidth can be, for example, 0.1 Hz or less and 5 Hz or more in the band-pass filter and 5 Hz or more in the low-pass filter.

The seizing diagnosis shown in FIG. 2 considers that the vibration of the vehicle body is generated depending on the type of the vehicle and the running environment. However, strictly speaking, the vibration of the vehicle body is also generated due to offsetting of the track. Thus, generation of the vehicle body vibration also depends on the state of the track of a route. Therefore, in the case where the track is in the normal size as arranged and the offsetting of the track is extremely small, the vibration generated in the vehicle is decreased irrespective of the running speed of the vehicle, and accordingly, the total extension/retraction displacement amount of the actuator is also decreased. Thus, there occurs an occasion that the seizing is falsely determined. In order to cope with such an occasion, the first threshold value $X_0$ serving as the evaluation reference of the total extension/retraction displacement amount X may be determined for each section of the route and individually registered by performing a running test in advance. However, in that case, the running test is required for the entire route and the management of the threshold value becomes complicated.

In the present invention, in order to rule out a condition in the case where the offsetting of the track is small, as a determination measure of seizing generation, a vibration acceleration acting on the vehicle body to which the actuator is coupled can be added. Hereinafter, specific procedures of the seizing diagnosis will be described.

Figure 3:
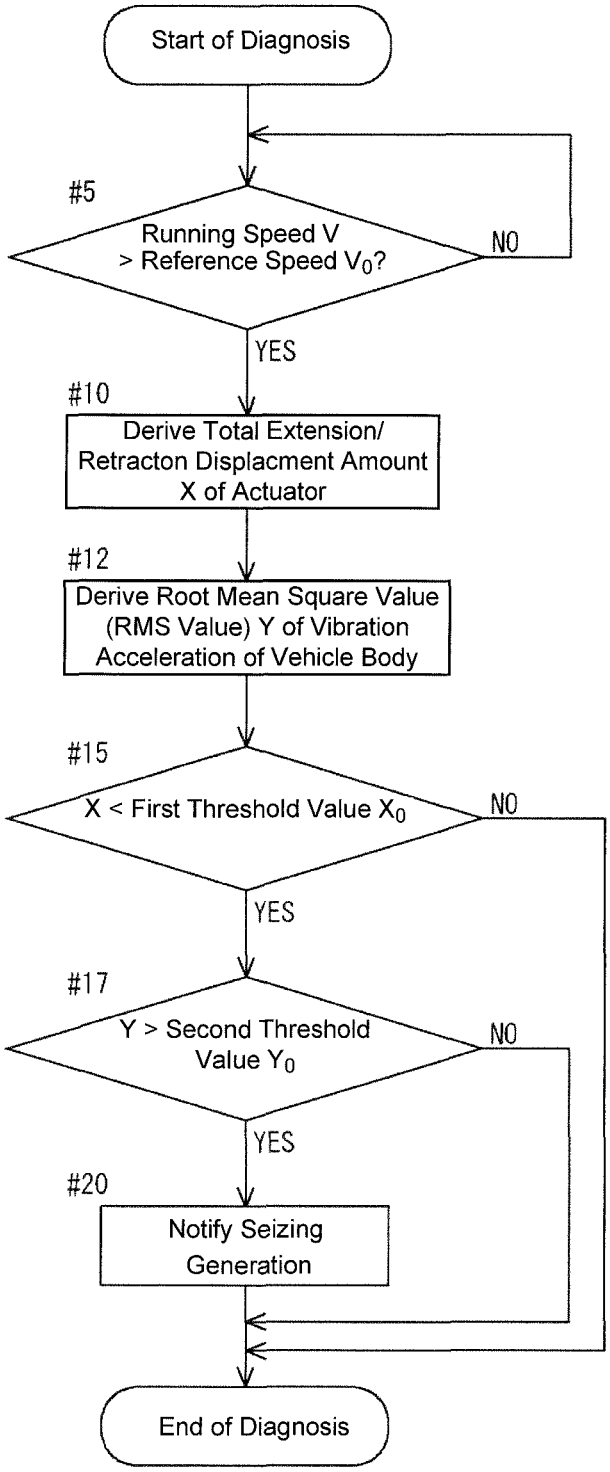
FIG. 3 is a flowchart showing another example of the procedures of the seizing diagnosis of the actuator according to the vibration suppression device of the present invention.

FIG. 3 is a flowchart showing another example of the procedures of the seizing diagnosis of the actuator according to the vibration suppression device of the present invention. In comparison to the seizing diagnosis shown in FIG. 2, the seizing diagnosis shown in the figure has commonality except that the determination measure of the seizing generation is partly different. It should be noted that in FIG. 3, the same steps as those shown in FIG. 2 are given the same step numbers.

When it is determined that the running speed V exceeds the reference speed $V_0$ in Step #5, the processing advances to Step #10, and the controller derives the total extension/retraction displacement amount X of the actuator within the predetermined period of time T. At the same time, in Step #12, the controller derives the Root Mean Square value (RMS value) Y of the vibration acceleration data acting on the vehicle body in a lateral direction within the predetermined period of time T. The RMS value Y of the vibration acceleration data can be derived by the following method.

As shown in FIG. 1, for the original purpose of the vibration suppression device, the vibration acceleration sensors 7 are provided in the vehicle body 1. The controller samples detection signals of vibration accelerations that are output from the vibration acceleration sensors 7 for every predetermined cycle Δt within the predetermined period of time T, calculates the square of the sampled vibration accelerations, and then finds the arithmetic mean and the square root thereof to acquire the RMS value Y of the vibration acceleration data.

After the total extension/retraction displacement amount X of the actuator is derived in Step #10 and further the RMS value Y of the vibration acceleration data of the vehicle body is derived in Step #12, the processing advances to Step #15, and the controller determines whether or not the total extension/retraction displacement amount X is smaller than the first threshold value $X_0$. When it is determined that the total extension/retraction displacement amount X is smaller than the first threshold value $X_0$ in Step #15, in this case, it can be considered that the extension/retraction motion of the actuator is small although the control of the vibration suppression by the actuator is performed within the predetermined period of time T. Thus, the controller primarily determines that there is a risk that the actuator might be seized, and the processing advances to Step #17.

In Step #17, the controller determines whether or not the RMS value Y of the vibration acceleration data is larger than a specified threshold value (second threshold value) $Y_0$. Information of the second threshold value $Y_0$ is preliminarily registered in the controller. When it is determined that the RMS value Y of the vibration acceleration data is larger than the second threshold value $Y_0$ in Step #17, in this case, it cannot be considered that the actuator should have extended and retracted, although the control of the vibration suppression by the actuator is required for attenuating an intensive vibration within the predetermined period of time T. Thus, the controller finally determines that the actuator is seized, and the processing advances to Step #20. The controller notifies of the seizing generation in Step #20 and completes the diagnosis.

Meanwhile, in the case where it is determined that the total extension/retraction displacement amount X is not smaller than the first threshold value $X_0$ in Step #15 or in the case where it is determined that the RMS value Y of the vibration acceleration data is not larger than the second threshold value $Y_0$ in Step #17, it can be considered that the actuator is sufficiently operated and well-functioning. Thus, the controller generates no alarm, displays a well-functioning note on the operation panel of the driver seat, or the like.

Here, at the time of deriving the RMS value of the vibration accelerations of the vehicle body, the detection signals from the vibration acceleration sensors installed in the vehicle body usually contain noises. Thus, as well as when deriving the total amount of extension/retraction displacements of the actuator described above, it is preferable that the processing of removing the noises is performed on the detection signals. For example, by the controller, the detection signals of the vibration acceleration sensors can be processed through a band-pass filter. In this case, the blocked frequency bandwidth at the time of filtering can be 0.1 Hz or less and 5 Hz or more.

The second threshold value $Y_0$ serving as an evaluation reference of the RMS value Y of the vibration acceleration data depends on the offsetting of the track in addition to the type of the vehicle and the running environment. Thus, the second threshold value $Y_0$ can be determined not only by performing the running test in advance but also by performing a three-dimensional simulation analysis on which the offsetting of the track of the route, specifications of the vehicle, and the like are reflected. For example, in a case of supposing the Shinkansen bullet train, in a simulation that a three-dimensional analysis model in which rigid connection is made between the vehicle body and the bogie truck is used and the offsetting of the track is input as a variable, when the vibration acceleration acting on the vehicle body in a lateral direction is processed through the band-pass filter for blocking the frequency of 0.1 Hz or less and 5 Hz or more, and the RMS value is calculated for every 5 seconds (sampling period T), the value becomes 0.2 [$m/s^2$] at minimum. From this simulation result, for a specific operation, the second threshold value $Y_0$ can be 0.2 [$m/s^2$].

INDUSTRIAL APPLICABILITY

According to the vibration suppression device for a railway vehicle of the present invention, the seizing of an actuator can be found with high precision at an early stage and hence promptly remedied. As a result, that a railway vehicle is operated while the riding comfort is degraded for a long time is prevented. Therefore, the present invention is quite useful for comfortable operation of a railway vehicle.

REFERENCE SIGNS LIST

1: Vehicle body
2: Bogie Truck
3: Rail
4: Controller
5: Actuator
6: Fluid pressure damper
7: Vibration acceleration sensor
11: Electric motor
12: Main shaft
13: Ball screw nut
14: Rod

What is claimed is:

1. A vibration suppression device for a railway vehicle, comprising:

an actuator disposed between a bogietruck and a vehicle body of the railway vehicle, the actuator adjusting a vibration of the railway vehicle by extension/retraction motion thereof; and a controller for controlling the extension/retraction motion of the actuator, the controller including:

a deriver deriving the total amount of extension/retraction displacements of the actuator within a predetermined period of time during the running of the railway vehicle, and a determiner using the derived total amount of extension/retraction displacements to determine if the actuator should be seized.

2. The vibration suppression device for a railway vehicle according to claim 1, wherein the actuator is an electric actuator for converting rotation motion of an electric motor into extension/retraction motion.

3. The vibration suppression device for a railway vehicle according to claim 2, wherein the deriver derives the total amount of extension/retraction displacements when a running speed of the railway vehicle exceeds a preliminarily registered speed.

4. The vibration suppression device for a railway vehicle according to claim 2, wherein the deriver derives the total amount of extension/retraction displacements of the actuator, derives the Root Mean Square Value (RMS value) of vibration acceleration data acting on the vehicle body in the same direction as the extension/retraction direction of the actuator within the predetermined period of time, and the determiner uses the derived total amount of extension/retraction displacements and the derived RMS value of the vibration acceleration data to determine if the actuator should be seized.

5. The vibration suppression device for a railway vehicle according to claim 2, further comprising:

a sensor for detecting extension/retraction displacement of the actuator, wherein the deriver derives the total amount of extension/retraction displacements based on detection signals of the sensor.

6. The vibration suppression device for a railway vehicle according to claim 2, further comprising:

a sensor for detecting extension/retraction speed of the actuator, wherein the deriver derives the total amount of extension/retraction displacements based on detection signals of the sensor.

7. The vibration suppression device for a railway vehicle according to claim 2, further comprising:

sensors for detecting accelerations in the extension/retraction direction, the sensors being respectively provided at the end of the actuator on the bogietruck side and at the end on the vehicle body side, wherein the deriver derives the total amount of extension/retraction displacements based on detection signals of the sensors.

8. The vibration suppression device for a railway vehicle according to claim 1, further comprising:

a sensor for detecting extension/retraction displacement of the actuator, wherein the deriver derives the total amount of extension/retraction displacements based on detection signals of the sensor.

9. The vibration suppression device for a railway vehicle according to claim 8, wherein the controller processes the detection signal of the sensor through a low-pass filter, performs the processing of subtracting a preliminarily registered zero-point value of the sensor, and the deriver derives the total amount of extension/retraction displacements based on the processed signals.

10. The vibration suppression device for a railway vehicle according to claim 8, wherein the controller processes the detection signal of the sensor through a band-pass filter and the deriver derives the total amount of extension/retraction displacements based on the processed signals.

11. The vibration suppression device for a railway vehicle according to claim 1, further comprising:

a sensor for detecting extension/retraction speed of the actuator, wherein the deriver derives the total amount of extension/retraction displacements based on detection signals of the sensor.

12. The vibration suppression device for a railway vehicle according to claim 11, wherein the controller processes the detection signal of the sensor through a band-pass filter and the deriver derives the total amount of extension/retraction displacements based on the processed signals.

13. The vibration suppression device for a railway vehicle according to claim 11, wherein the controller processes the detection signal of the sensor through a low-pass filter, performs the processing of subtracting a preliminarily registered zero-point value of the sensor, and the deriver derives the total amount of extension/retraction displacements based on the processed signals.

14. The vibration suppression device for a railway vehicle according to claim 1, further comprising:

sensors for detecting accelerations in the extension/retraction direction, the sensors being respectively provided at the end of the actuator on the bogietruck side and at the end on the vehicle body side, wherein the deriver derives the total amount of extension/retraction displacements based on detection signals of the sensors.

15. The vibration suppression device for a railway vehicle according to claim 14, wherein the controller processes the detection signal of the sensor through a band-pass filter and the deriver derives the total amount of extension/retraction displacements based on the processed signals.

16. The vibration suppression device for a railway vehicle according to claim 14, wherein the controller processes the detection signal of the sensor through a low-pass filter, performs the processing of subtracting a preliminarily registered zero-point value of the sensor, and the deriver derives the total amount of extension/retraction displacements based on the processed signals.

17. The vibration suppression device for a railway vehicle according to claim 1, wherein the deriver derives the total amount of extension/retraction displacements when a running speed of the railway vehicle exceeds a preliminarily registered speed.

18. The vibration suppression device for a railway vehicle according to claim 1, wherein the deriver derives the total amount of extension/retraction displacements of the actuator, derives the Root Mean Square Value (RMS value) of vibration acceleration data acting on the vehicle body in the same direction as the extension/retraction direction of the actuator within the predetermined period of time, and the determiner uses the derived total amount of extension/retraction displacements and the derived RMS value of the vibration acceleration data to determine if the actuator should be seized.

19. The vibration suppression device for a railway vehicle according to claim 18, further comprising:

a vibration acceleration sensor for detecting the vibration acceleration acting on the vehicle body in the same direction as the extension/retraction direction of the actuator, wherein the controller processes a detection signal of the vibration acceleration sensor through a band-pass filter, and the deriver derives the RMS value of the vibration acceleration data based on the processed signals.

* * * * *